US008060986B1

(12) United States Patent
Green

(10) Patent No.: US 8,060,986 B1
(45) Date of Patent: Nov. 22, 2011

(54) CHAIN SAW HANDLE APPARATUS

(76) Inventor: Donald L. Green, Riley, MI (US)

( * ) Notice: Subject to any disclaimer, the term of this patent is extended or adjusted under 35 U.S.C. 154(b) by 0 days.

(21) Appl. No.: 12/849,656

(22) Filed: Aug. 3, 2010

(51) Int. Cl.
*B25G 1/00* (2006.01)

(52) U.S. Cl. ..... 16/426; 30/381; 30/296.1

(58) Field of Classification Search ..... 30/381, 30/296.1; 81/489; 16/426, 427, 422, 429, 16/110.1, 436, 440
See application file for complete search history.

(56) References Cited

U.S. PATENT DOCUMENTS 3,823,474 A * 7/1974 Ionescu ..... 30/383
3,949,817 A * 4/1976 Rice ..... 173/170
4,290,202 A * 9/1981 Nadenoff ..... 30/382
4,657,234 A * 4/1987 Stout ..... 269/97
4,757,613 A * 7/1988 Baudreau et al. ..... 30/383
4,841,641 A 6/1989 Laidlaw
5,669,145 A 9/1997 Skripsky
5,960,549 A * 10/1999 Hoppner ..... 30/381
6,918,185 B2 * 7/2005 Barger ..... 30/296.1
2004/0016130 A1 1/2004 Barger

* cited by examiner

*Primary Examiner* — William L. Miller
(74) *Attorney, Agent, or Firm* — Crossley Patent Law; Mark A. Crossley

(57) ABSTRACT

The chain saw handle apparatus provides for removable attachment to a chain saw handle wherein the elongate arm of the apparatus is disposed above or lateral to the center of gravity of the chain saw and the lower section of the apparatus attached medially to the chain saw handle. The apparatus provides needed leverage for starting and operating the chain saw while reducing fatigue typically experienced in the operation thereof.

3 Claims, 4 Drawing Sheets

FIG. 4
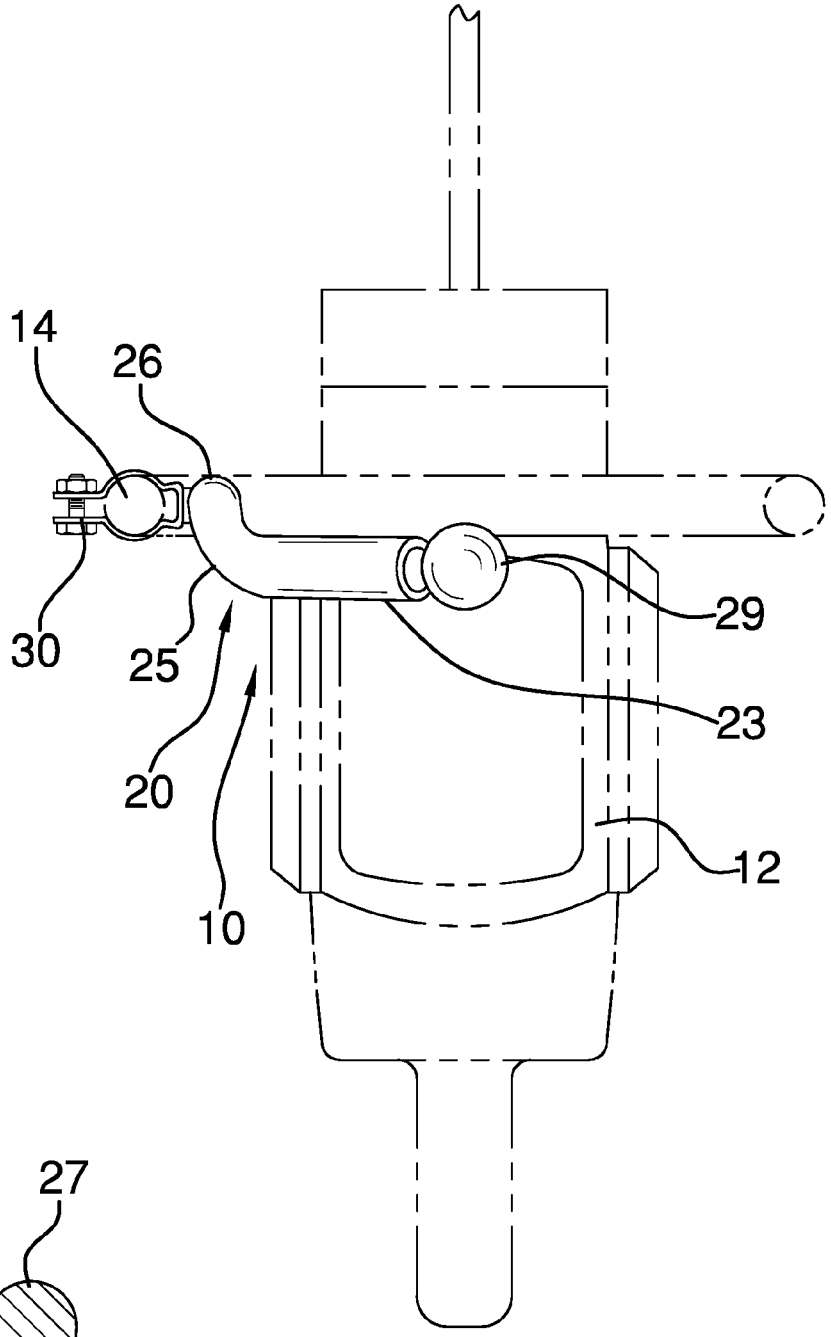
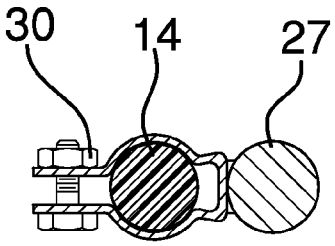
FIG. 3

CHAIN SAW HANDLE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Anyone using a chain saw becomes instantly aware of several problems faced. First, starting a chain saw is arduous because trying to steady the saw while pulling the starter rope is extremely difficult, and dangerous. Correctly guiding and balancing a chain saw during operation is also difficult. Incorrect saw guidance results in inaccurate cuts and in chain saw loading, especially on the clutch, and also causes the saw to dangerously buck. These difficulties contribute to chain saw overheating and wear. Without question, use of chain saw is dangerous, fatiguing and can cause muscle and joint pain. The present apparatus solves these problems.

FIELD OF THE INVENTION

The chain saw handle apparatus relates to chain saws and more especially to a chain saw handle apparatus selectively and removably affixed to an existing chain saw handle.

SUMMARY OF THE INVENTION

The general purpose of the chain saw handle apparatus, described subsequently in greater detail, is to provide a chain saw handle apparatus which has many novel features that result in an improved chain saw handle apparatus which is not anticipated, rendered obvious, suggested, or even implied by prior art, either alone or in combination thereof.

To attain this, the chain saw handle apparatus provides for better and more ergonomical user support of a chain saw. The apparatus provides several key advantages. First, the apparatus removably attaches to the existing handle of a chain saw, thereby negating any intrusion on the function or use of the implement. By virtue of design, the apparatus handle is positioned in line with the center of gravity of the chain saw, an important feature in both guidance and balance of the saw. Further, the apparatus provides the leverage needed to more effectively balance a chain saw in both starting and in use, both typically quite difficult. The apparatus does not in any way attach to a user, which is important for safety. More effective chain saw support provides for easier use, without typical user fatigue and pain, for better cuts, for less binding and saw bucking, and for greater chain saw life. Without chain saw binding, the saw does not easily overheat or damage its clutch or other parts. An added advantage is that the apparatus can be installed directionally as desired on most chain saw handles, thereby allowing for attachment for upright, angular, or even horizontal cuts, without a user having to try to awkwardly manipulate the chain saw for such cuts. The apparatus may be tubular to decrease weight. Attachment to and detachment from a saw are easily and quickly accomplished via the two clamps. And, the apparatus does not bias saw use toward one hand position, but accommodates many. The handle is in line with the chain. This keeps the cuts straight. Further, the handle is the same length as the bar. The device also functions with a saws all.

The clamps which attach the elongate handle to an existing chain saw handle may be the illustrated style or may be cam locks, worm clamps, or any of a host of other clamps known in clamping arts. Clamps may provide permanent or temporary installation onto a chain saw.

Both the upper section and the lower section may be straight or may also feature various angles and curves to best serve a user and to best adapt to various chain saws. The diameter reduction disposed between the knob and the upper section importantly enhances grip on the knob.

Thus has been broadly outlined the more important features of the improved chain saw handle apparatus so that the detailed description thereof that follows may be better understood and in order that the present contribution to the art may be better appreciated.

An object of the chain saw handle apparatus is to provide for greater control of a chain saw.

Another object of the chain saw handle apparatus is to provide for more balanced control of a chain saw.

A further object of the chain saw handle apparatus is to provide for greater safety in chain saw use.

An added object of the chain saw handle apparatus is to easily attach to and detach from a chain saw handle.

And, an object of the chain saw handle apparatus is to provide for more accurate cuts.

Yet another object of the chain saw apparatus is to extend the life of a chain saw and its components.

Still another object of the chain saw apparatus is to prevent fatigue and discomfort in chain saw use.

And, an object of the chain saw handle apparatus is to provide for a plurality of hand positions in chain saw use.

These together with additional objects, features and advantages of the improved chain saw handle apparatus will be readily apparent to those of ordinary skill in the art upon reading the following detailed description of presently preferred, but nonetheless illustrative, embodiments of the improved chain saw handle apparatus when taken in conjunction with the accompanying drawings.

In this respect, before explaining the current embodiments of the improved chain saw handle apparatus in detail, it is to be understood that the chain saw handle apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved chain saw handle apparatus. It is therefore important that the claims be regarded as including such equivalent constructions insofar as they do not depart from the spirit and scope of the chain saw handle apparatus. It is also to be understood that the phraseology and terminology employed herein are for purposes of description and should not be regarded as limiting.

BRIEF DESCRIPTION OF THE DRAWINGS

FIG. 3 is a partial cross sectional view of FIG. 2, taken along the line 3-3.

FIG. 4 is a top plan view of the installed apparatus.

DETAILED DESCRIPTION OF THE DRAWINGS

With reference now to the drawings, and in particular FIGS. 1 through 5 thereof, the principles and concepts of the chain saw handle apparatus generally designated by the reference number 10 will be described.

Figure 5:
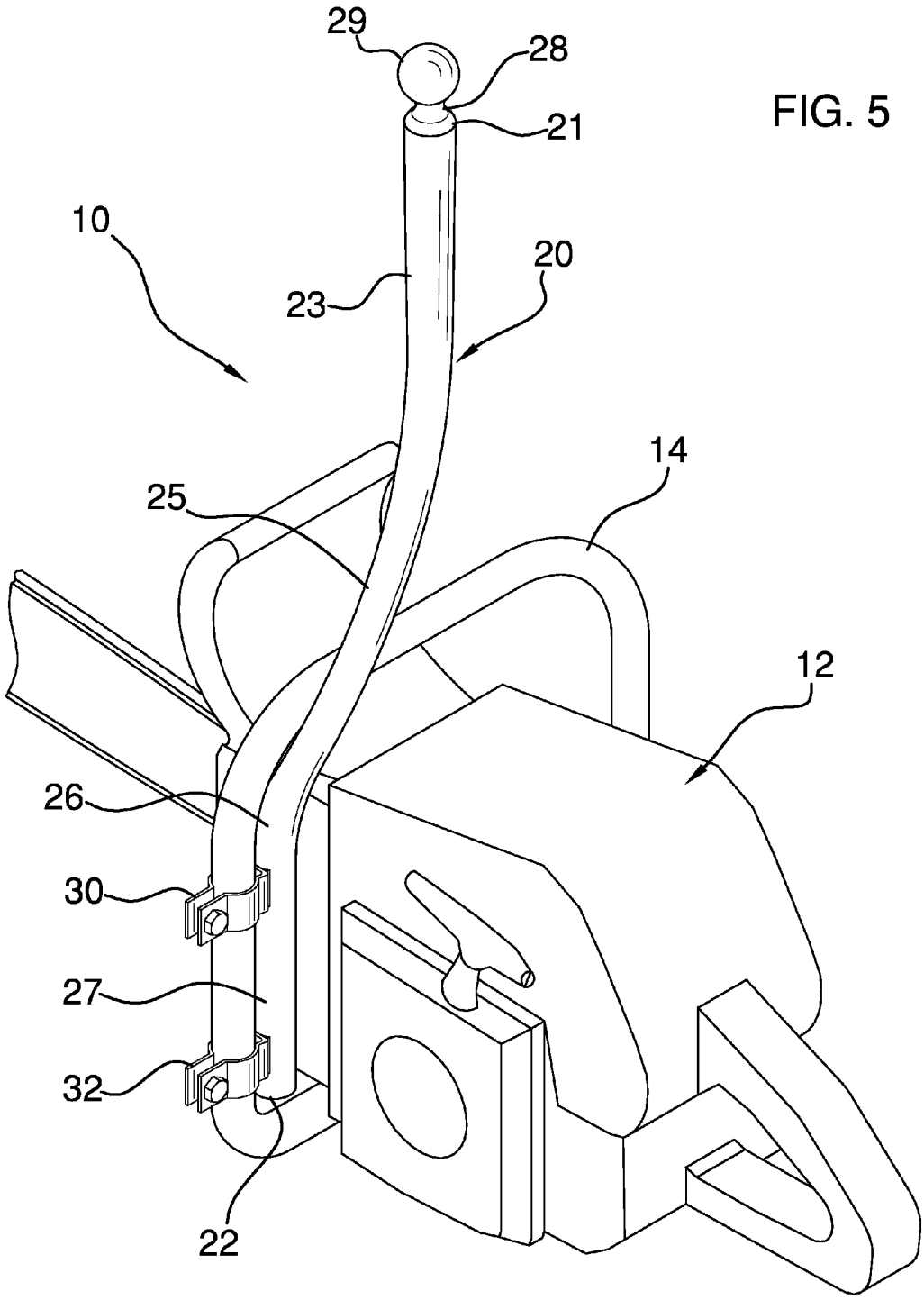
FIG. 5 is a rear perspective view of the installed apparatus.

Referring to FIG. 5, the apparatus 10 is affixed to the existing handle 14 of the existing chain saw 12. It is important to note that, while the clamps are affixed to the left side of the existing handle 14, they may as easily be affixed to the opposite handle 14 side or to the handle 14 top, thereby angling the elongate arm 20 as desired.

Figure 2:
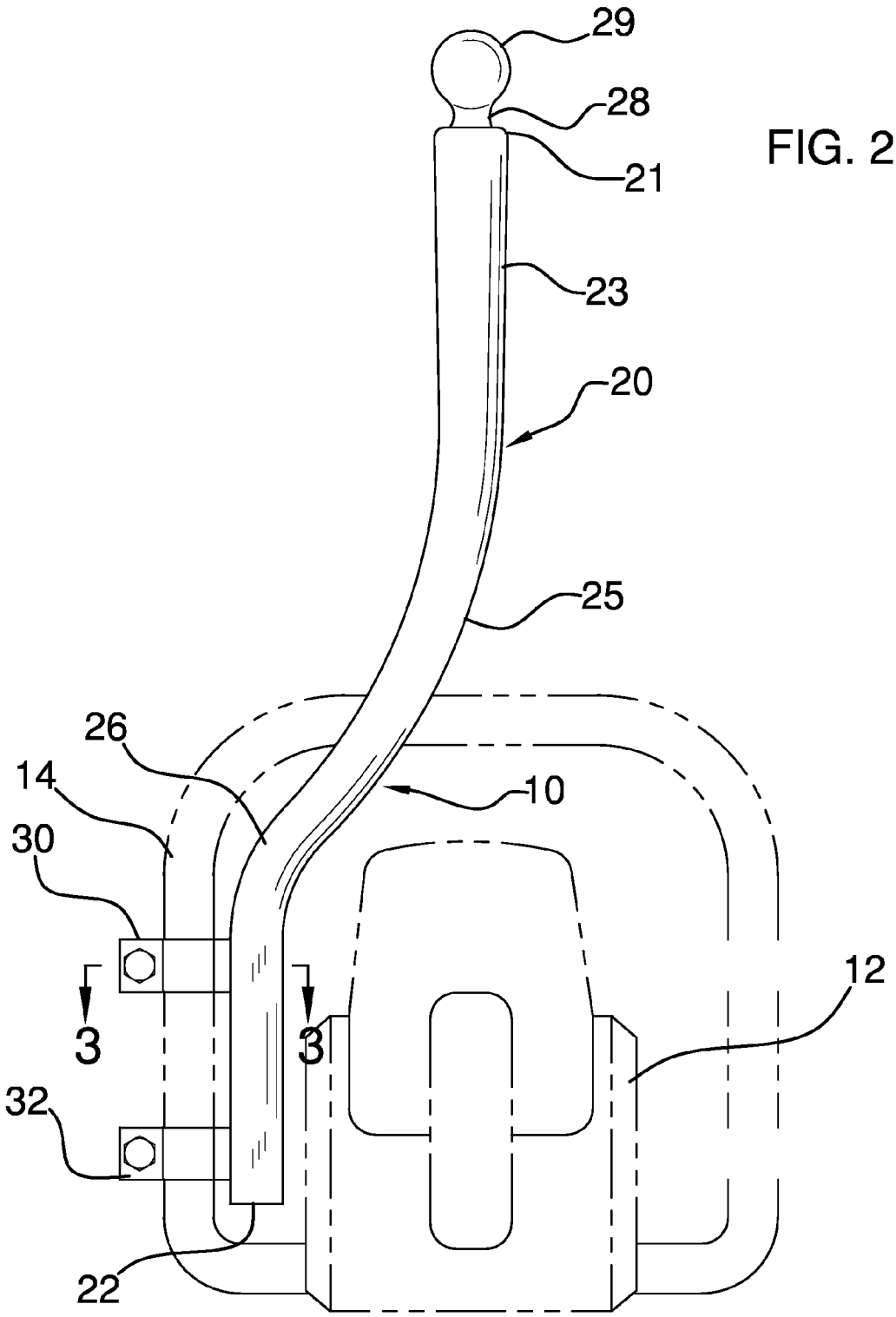
FIG. 2 is a rear elevation view of the apparatus attached to a chains saw handle.

Referring to FIG. 2, the elongate arm 20 comprises a first end 21 spaced apart from the second end 22. In this representation, the apparatus 10 is affixed such that the lower section 27 and the upper section 23 are both oriented vertically upward; however, in noting again the typical handle 14, the apparatus 10 may also be removably fastened to the right side of the handle 14 or to the upper horizontal portion of the handle 14 in order to most comfortably use the apparatus 10 in a given application. The diameter reduction 28 is disposed atop the first end 21. The knob 29 is disposed atop the diameter reduction 28. The straight upper section 23 is extended downwardly from the first end 21. The gradual bend 25 is disposed downwardly on the straight upper section 23. The partially counter-directional sharper bend 26 is disposed downwardly from the gradual bend 25. The straight lower section 27 is disposed downwardly from the sharper bend 26.

Continuing to refer to FIG. 2 and referring also to FIG. 3, the pair of spaced apart clamps comprises the first clamp 30 and the second clamp 32. The parallel clamps are each disposed laterally on the lower section 27. The clamps are selectively and removably affixed to the existing handle 14 of the existing chain saw 12.

Referring to FIG. 4, the elongate arm 20 importantly features the gradual bend 25 and the lower sharper bend 26 that is partially counter-directional to the gradual bend 25 such that the elongate arm 20 upper section 23 is disposed above the center of gravity of the chain saw 12 and the lower section is importantly disposed medially on the existing handle 14. These features not only importantly provide for best handling balance but also negate incursion into tight working spaces by the lower section 27.

Figure 1:
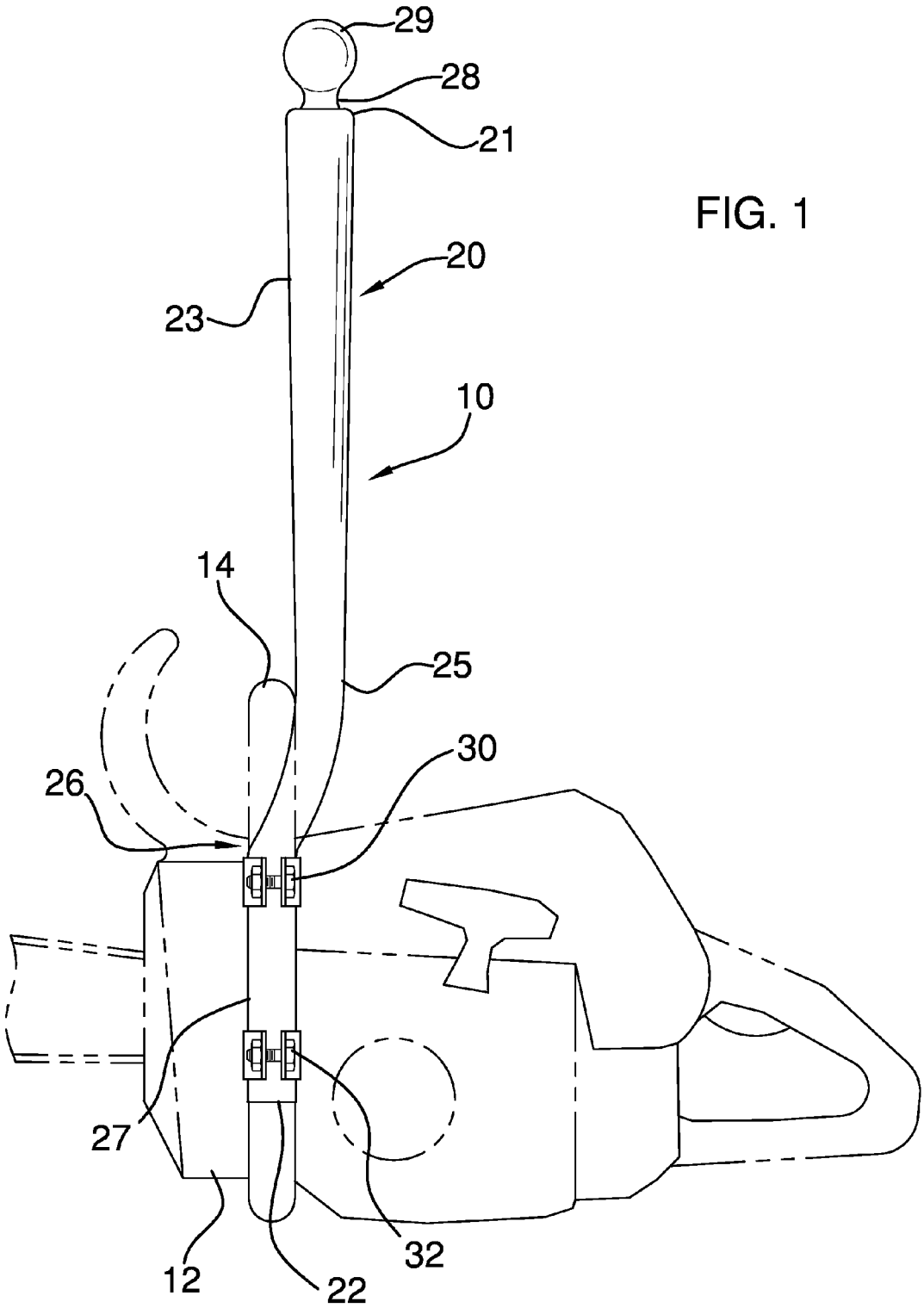
FIG. 1 is a lateral elevation view of the apparatus attached to a chain saw handle.

Referring to FIG. 1, the first clamp 30 and the second clamp 32 importantly provide for easy external access whereby the apparatus 10 is easily attached to and removed from the existing handle 14.

With respect to the above description then, it is to be realized that the optimum dimensional relationships for the parts of the chain saw handle apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the chain saw handle apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the chain saw handle apparatus may be used.

Therefore, the foregoing is considered as illustrative only of the principles of the chain saw handle apparatus. Further, since numerous modifications and changes will readily occur to those skilled in the art, it is not desired to limit the chain saw handle apparatus to the exact construction and operation shown and described, and accordingly, all suitable modifications and equivalents may be resorted to, falling within the scope of the chain saw handle apparatus.

What is claimed is:

1. A chain saw handle apparatus comprising:

an elongate arm comprising:

a first end spaced apart from a second end;

an upper section extended downwardly from the first end;

a bend disposed downwardly on the upper section;

a partially counter-directional bend disposed downwardly from the bend;

a lower section disposed downwardly from the partially counter-directional bend;

a pair of spaced apart clamps comprising a first clamp and a second clamp, the clamps disposed laterally and parallel on the lower section;

whereby the clamps are affixed to an existing handle of an existing chain saw, the upper section disposed upwardly above a center of gravity of the chain saw, the bends providing for the lower section to be attached medially to the chain saw handle.

2. A chain saw handle apparatus comprising:

an elongate arm comprising:

a first end spaced apart from a second end;

an upper section extended downwardly from the first end;

a gradual bend disposed downwardly on the upper section;

a partially counter-directional sharper bend disposed downwardly from the gradual bend;

a lower section disposed downwardly from the sharper bend;

a pair of spaced apart clamps comprising a first clamp and a second clamp, the clamps disposed laterally and in parallel on the lower section;

whereby the clamps are affixed to an existing handle of an existing chain saw, the upper section disposed upwardly above a center of gravity of the chain saw, the bends providing for the lower section to be attached medially to the chain saw handle.

3. A chain saw handle apparatus comprising:

an elongate arm comprising:

a first end spaced apart from a second end;

a diameter reduction disposed atop the first end;

a knob disposed atop the diameter reduction;

a straight upper section extended downwardly from the first end;

a gradual bend disposed downwardly on the straight upper section;

a partially counter-directional sharper bend disposed downwardly from the gradual bend;

a straight lower section disposed downwardly from the sharper bend;

a pair of spaced apart clamps comprising a first clamp and a second clamp, the clamps each disposed laterally and in parallel on the lower section;

whereby the clamps are selectively and removably affixed to an existing handle of an existing chain saw, the upper section disposed upwardly above a center of gravity of the chain saw, the bends providing for the lower section to be attached medially to the chain saw handle.

* * * * *